US010240397B2

(12) United States Patent
Ahonen et al.

(10) Patent No.: US 10,240,397 B2
(45) Date of Patent: Mar. 26, 2019

(54) HAMMERING AND ROTATABLE DRILL BIT

(71) Applicant: MINCON NORDIC OY, Lempäälä (FI)

(72) Inventors: Jukka Ahonen, Tampere (FI); Jussi Sammatti, Pinsio (FI)

(73) Assignee: MINCON NORDIC OY, Lempäälä (FI)

( * ) Notice: Subject to any disclaimer, the term of this patent is extended or adjusted under 35 U.S.C. 154(b) by 30 days.

(21) Appl. No.: 15/112,566

(22) PCT Filed: Jan. 20, 2015

(86) PCT No.: PCT/FI2015/000002
§ 371 (c)(1),
(2) Date: Jul. 19, 2016

(87) PCT Pub. No.: WO2015/107262
PCT Pub. Date: Jul. 23, 2015

(65) Prior Publication Data

US 2016/0333644 A1 Nov. 17, 2016

(30) Foreign Application Priority Data

Jan. 20, 2014 (FI) ..... 20140015

(51) Int. Cl.
*E21B 10/38* (2006.01)
*E21B 10/40* (2006.01)
(Continued)

(52) U.S. Cl.
CPC ..... *E21B 10/40* (2013.01); *E21B 4/06* (2013.01); *E21B 10/38* (2013.01)

(58) Field of Classification Search
CPC . E21B 10/40; E21B 10/38; E21B 4/06; E21B 10/26
See application file for complete search history.

(56) References Cited

U.S. PATENT DOCUMENTS 2,532,783 A 12/1950 Phipps
2,767,958 A 10/1956 Silvola
(Continued)

FOREIGN PATENT DOCUMENTS

CN 201714302 U 1/2001
DE 19601237 A1 7/1996
(Continued)

OTHER PUBLICATIONS

Supplementary European Search Report for Application No. EP 15 73 7159, 2 pages, Aug. 10, 2017.
(Continued)

*Primary Examiner* — Catherine Loikith
(74) *Attorney, Agent, or Firm* — FisherBroyles, LLP

(57) ABSTRACT

A hammering and rotatable drill bit, which is meant for ground and rock drilling includes a hollow shaft having a hole that is adjusted to direct flushing air onto the drilling surface to the front of the drill bit and further from there towards the outer edge of the drill bit. the drill bit includes a drilling part which protrudes from the surface of the drill bit, functions as a drill point and drills the mid-area of the hole to be created wherein the mentioned part is adjusted to prevent the flushing flow from flowing directly through the mentioned hole located inside the shaft onto the drilling surface. The mentioned part is arranged to allow the outlet of the flushing flow in a sideways direction to the grooves belonging to the drilling surface, which grooves lead to the edge of the drill bit, and is arranged to allow the outlet also partly to the front of the drill bit to the drilling surface by adjusting the groove, which leads to the edge of the drill bit, to start from the mentioned part from such a distance (d) from the center line (L) of the drill bit which distance (d) is less than the radius (R) of the hole.

9 Claims, 1 Drawing Sheet

(51) Int. Cl.
*E21B 10/26* (2006.01)
*E21B 4/06* (2006.01)

(56) References Cited

U.S. PATENT DOCUMENTS

| | | | |
|---|---|---|---|
| 2003/0079915 | A1 | 5/2003 | Mocivnik et al. |
| 2007/0227777 | A1 | 10/2007 | Simmons |

FOREIGN PATENT DOCUMENTS

| | | | |
|---|---|---|---|
| EP | 1818499 | A1 | 8/2007 |
| FI | 124745 | B | 1/2015 |
| JP | 2001020651 | A | 1/2001 |
| WO | WO00/26576 | A1 | 5/2000 |
| WO | WO2015107262 | A1 | 7/2015 |

OTHER PUBLICATIONS

Official Action, FI Application No. 20140015, 4 pages, Sep. 29, 2014.

HAMMERING AND ROTATABLE DRILL BIT

CROSS-REFERENCE TO RELATED APPLICATION

This application is a National Stage application of International Application No. PCT/FI2015/000002, filed Jan. 20, 2015, which claims priority to Finnish Application No. 20140015, filed Jan. 20, 2014, which are incorporated by reference herein in their entireties.

BACKGROUND

Field

Object of the invention is a hammering and rotatable drill bit belonging to a drilling device and meant for ground and rock drilling through a hollow shaft of which bit flushing air is directed to the drilling surface to the front of the drill bit and further from it towards the outer edge of the drill bit.

Description of the Related Art;

Dill bits according to the above presented preamble are previously known for example from a Finnish patent application no. 20120269 in which flushing air is directed towards the centre of the drill bit and the flushing flow is turned to the side inside the drill bit from which location it continues along the duct which is located inside the drill bit till the duct opens to be a groove, which leads towards the outer edge of the drill bit on the surface of the drill bit.

In the above described publication a drill bit is presented with the structure of which drill bit one aims to prevent the strong flushing flow from hitting the drilling surface when soft ground is being drilled. The flushing flow is directed towards the edge of the drill bit being fully turned in a sideways direction and when it has reached the surface of the drill bit it is still directed in a groove on the surface of the drill bit. This kind of flushing flow is capable of transferring the soft ground away from the drilling surface when the drill bit rotates and there is enough flow in the grooves of the drill bit which flow is not directed towards the surface to be drilled but towards the outer edge of the drill bit. In this solution the midarea of the drill bit will have a weak structure because inside the drill bit the flushing duct, which is directed to the front, must be arranged very close to the front surface of the drill bit and the ducts that are directed to the side from it are also located very close to front surface of the drill bit covering the distance when they are inside the bit crown. In the above mentioned implementation the mid-area of the drill bit also gets very little flushing because all the flushing air is directed in the direction of the radius of the crown along the drilled holes to the edges of the crown.

SUMMARY

In order to eliminate the above presented disadvantages a new drill bit has been developed with the help of which drill bit an essential improvement can be reached in relation to the known technology. It is characteristic of the invention that the mentioned part is arranged to allow the outlet of the flushing flow in a sideways direction to the grooves belonging to the drilling surface which grooves are directed to the edge of the drill bit and to allow the outlet also partly to the front of the drill bit to the drilling surface by adjusting the groove, which leads to the edge of the drill bit, to start from the mentioned part from such a distance from the centre line of the drill bit which distance is less than the radius of the hole of the flushing duct.

The advantage of the invention is the fact that the structure of the drill bit can be made to be stronger, further a part that directs the drilling is created to the front part of the drill bit when at the same time the part is being utilized for the arranging of the flushing agent ducts. The flushing agent flow is not directed perpendicularly to the drilling surface but mainly to the side and only partly diagonally towards the drilling surface and thus does not loosen too much soil from the drilling surface. The flushing flow is released to the frontal surface of the bit from nearby the centre point of the bit in which case the flushing air carries all the drilled material away with it and no drilled material will be left in the mid-area. Air flow bursts out mainly in a sideways direction and the flow is spread considerably widely and evenly because the flow is not directed by directing it along the drilled hole. Because the flushing agent bursts out immediately from the mid-hole, the pressure drops strongly and no excessive flushing is directed onto the drilling surface which would cause the air to penetrate into the ground or would loosen too much soil.

BRIEF DESCRIPTION OF THE DRAWINGS

In the following the invention is described more detailed by referring to the accompanying drawing in which.

DETAILED DESCRIPTION

Figure 1:
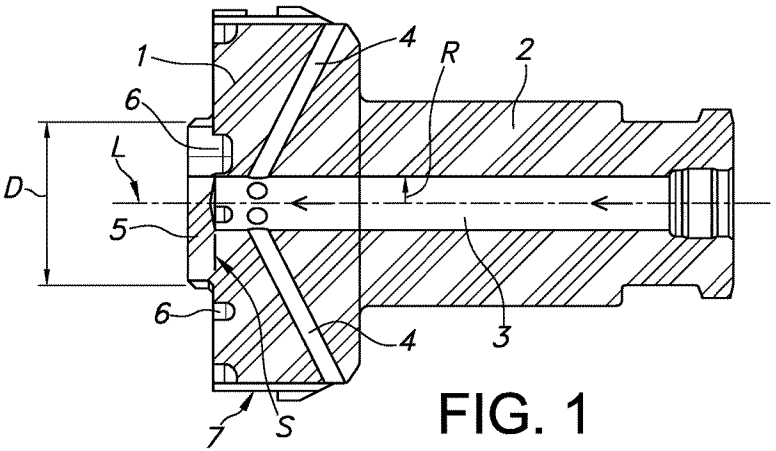
FIG. 1 shows a drill bit according to the invention as a side and section view.

In the FIG. 1 the drill bit 1 and the shaft 2 belonging to it are shown as a section view. The flushing flow is directed through a hole 3 which is directed through the drill bit 1 and the centre line L of the shaft towards the front surface of the drill bit 1. The hole 3 however ends at a planar directing part 5 before the mentioned surface and the flushing flow is turned to the side with the help of such a solution in which it is possible for the flushing flow to move in a sideways direction towards the outer edge of the drill bit 1 along grooves 6 which are formed to be curvilinear. These grooves 6 also transfer the drilling waste to the outer edge of the drill bit 1 and further from there backwards along an outlet duct 7 and further along the drilled hole onto the ground surface.

The hole 3 ends in the drill bit 1 at the level s in such a way that the grooves 6 start from the side of the hole 3 in this case in three different directions. The grooves 6 are still split immediately at their starting part to be two separate grooves 6. The grooves 6 are arranged in relation to the hole 3 in such a way that the grooves 6 start from the centre line L of the drill bit 1 at the distance d which is less than the radius R of the hole 3. The starting point of the grooves 6 is located at the distance d from the centre line L and this distance d is less than the radius R of the hole 3. This results in a fact that the flushing flow can partly turn also diagonally towards the drilling surface when one of its parts, most advantageously exactly the largest part, turns in a sideways direction and proceeds along the grooves 6 in a sideways direction.

At the same time the grooves 6 start from the part 5 which is formed in the centre of the drill bit 1 and drills the mid-area of the hole in which case the grooves 6 are deeper regarding this part than outside the mentioned part 5. Due to the part 5 the hole 3 can be extended inside the drill bit 1 at least to the same level where the front surface of the drill bit 1 is outside the part 5. The part 5 also functions as the directing part of the drilling by drilling the top part of the hole. Due to the part 5 the drilling surface of the drill bit 1 can be made to endure drilling hammerings despite the weakening caused by the hole 3 which weakening in this case will be nearly eliminated. The diameter D of the part 5 is most advantageously 25-60% of the diameter of the drill bit 1.

In one implementation way in order to reduce the flushing flow to be directed onto the drilling surface inside the drill bit 1, part of the flushing flow is turned to be a return flow with the help of ducts 4 already before the hole 3 ends.

Figure 2:
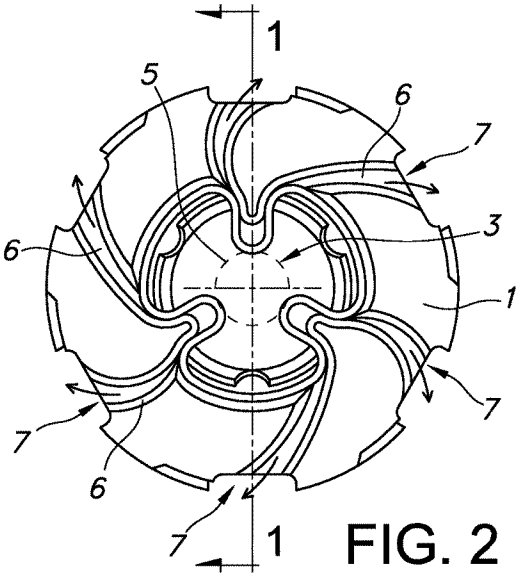
FIG. 2 shows the drill bit of the FIG. 3 directly from the front.
Figure 3:
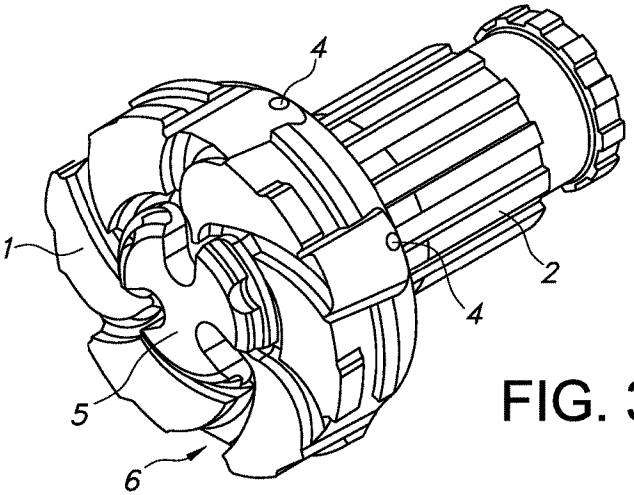
FIG. 3 shows a drill bit according to the invention diagonally seen.

FIG. 2 shows the drill bit from the front and FIG. 3 diagonally as a side view. It can be seen in the figures that the starting points of the grooves 6 start from inside a cylindrical part. It can be seen in the FIG. 2 that the length of the radius of the hole 3 is slightly longer than the distance from the centre line L of the hole 3 to the starting point of the grooves 6.

Figure 4:
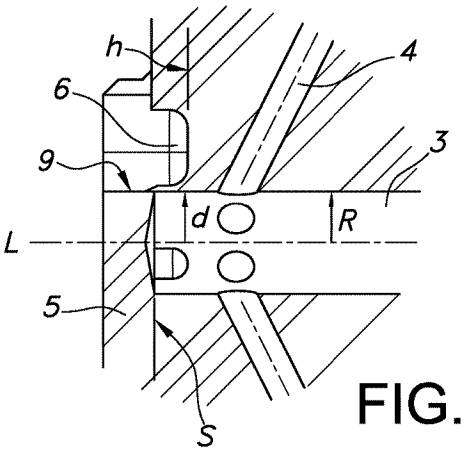
FIG. 4 shows the directing part as an enlargement.

In the FIG. 4 the starting point of the groove 6 is shown more accurately in which starting point the groove 6 has a starting wall 9 which is directed in the drilling direction. The bottom of the groove 6 is at the level h and the bottom of the hole 3 is at the level s. The distance d of the starting wall 9, in other words the starting point of the groove 6 from the centre line L of the hole 3 is most advantageously 0.7-0.99×R in which case R is the radius of the hole 3

What is claimed is:

1. A hammering and rotatable drilling device for ground and rock drilling, said drilling device comprising:

a drill bit defining a drilling surface at a front portion thereof and an outer edge, said drilling surface including a plurality of grooves, and;

a hollow shaft, said shaft connected to said drill bit and having a hole defining a radius which is adjusted to direct a flushing flow onto the drilling surface at the front of the drill bit and further from there towards the outer edge of the drill bit; and wherein the drill bit comprises a drilling part which protrudes from the front portion of the drill bit, functions as a drill point and drills a mid-area of a drilled hole to be created wherein the drilling part is adjusted to prevent the flushing flow from flowing directly through the hole located inside the shaft onto the drilling surface, wherein the drilling part is arranged to allow a portion of the flushing flow to exit the hole in the shaft in a sideways direction to the grooves belonging to the drilling surface which grooves lead to the outer edge of the drill bit and is also arranged to allow a portion of the flushing flow to exit the hole in the shaft in a forward direction towards the front portion of the drill bit to the drilling surface by adjusting the grooves, which lead to the outer edge of the drill bit, to start from the drilling part from a distance from a centre line of the drill bit, and wherein said distance is less than the radius of the hole in the shaft.

2. The drilling device according to claim 1, wherein the grooves are adjusted to such depth adjacent the drilling part such that the grooves extend deeper in the drill bit than a level defining a bottom of the hole.

3. The drilling device according to claim 1, wherein each of said grooves includes a starting point, and wherein the distance of the starting point from the centre line of the hole is (0.7-0.99)×R when R is the radius of the hole.

4. The drilling device according to claim 1, wherein each of said grooves includes a starting wall defining a starting point, and wherein the starting wall is directed in a drilling direction.

5. The drilling device according to claim 1, wherein the hole which is located inside the drill bit extends to a level which is beyond a level defining a bottom of one of said grooves near a starting point of said one of said grooves.

6. The drilling device according to claim 1, wherein said drill bit further includes a plurality of ducts extending from said hole towards said outer edge, and wherein part of the flushing flow is directed to turn backwards along the ducts that are formed inside the drill bit.

7. The drilling device according to claim 1, wherein the drilling part has a drilling diameter of 25-60% of a drilling diameter of the drill bit.

8. The drilling device according to claim 1, wherein the drilling part includes a planar directing surface.

9. The drilling device according to claim 1, wherein the grooves are at least partly curvilinear.

* * * * *